US011542738B2

(12) United States Patent
Daniels

(10) Patent No.: US 11,542,738 B2
(45) Date of Patent: Jan. 3, 2023

(54) DOOR CLOSERS

(71) Applicant: SAMUEL HEATH & SONS PLC, West Midlands (GB)

(72) Inventor: Adam Paul Daniels, West Midlands (GB)

(73) Assignee: Samuel Heath & Sons PLC, Birmingham (GB)

( * ) Notice: Subject to any disclaimer, the term of this patent is extended or adjusted under 35 U.S.C. 154(b) by 0 days.

(21) Appl. No.: 17/168,760

(22) Filed: Feb. 5, 2021

(65) Prior Publication Data

US 2021/0262270 A1 Aug. 26, 2021

Related U.S. Application Data

(63) Continuation-in-part of application No. 16/485,266, filed as application No. PCT/GB2018/050394 on Feb. 13, 2018, now Pat. No. 10,927,580.

(30) Foreign Application Priority Data

Feb. 13, 2017 (GB) ..... 1702330

(51) Int. Cl.
*E05F 3/20* (2006.01)
*E05F 1/12* (2006.01)
*E05F 1/00* (2006.01)

(52) U.S. Cl.
CPC ..... *E05F 1/00* (2013.01); *E05F 1/12* (2013.01); *E05F 3/20* (2013.01)

(58) Field of Classification Search
CPC ... E05F 3/20; E05F 3/226; E05F 3/108; E05F 1/12
See application file for complete search history.

(56) References Cited

U.S. PATENT DOCUMENTS 370,468 A * 9/1887 Griffing et al. ..... E05F 3/20 16/68
642,691 A * 2/1900 Hillenbrand ..... E05D 7/0027 16/244

(Continued)

FOREIGN PATENT DOCUMENTS

CN 101166882 A 4/2008
CN 201513043 U 6/2010

(Continued)

OTHER PUBLICATIONS

UK Search Report, dated Aug. 31, 2021, in GB Patent Application No. 2112141.3, 2 pp.

(Continued)

*Primary Examiner* — Jeffrey O'Brien
(74) *Attorney, Agent, or Firm* — Leydig, Voit & Mayer, Ltd.

(57) ABSTRACT

A door closer, including:
an anchor assembly, including:
a frame mounting plate which is fixable relative to a door frame; and
an adjustor plate; and
an actuator assembly for mounting within the thickness of a door leaf to move the door leaf between open and closed configurations relative to the door frame, the actuator assembly including an operating member coupled by a link to the adjustor plate and mounted for a range of movements between a fully retracted position, in which the anchor assembly is held adjacent the actuator assembly when the door leaf is in the closed configuration, and an extended position, in which the anchor assembly is in spaced relation to the actuator assembly when the door leaf is in the open configuration, the link being configured to extend from the adjustor plate along a first axis, wherein the frame
(Continued)

mounting plate is provided with one or more slot(s), the or each slot being elongated along a second axis, the second axis being generally orthogonal to the first axis.

9 Claims, 9 Drawing Sheets

(56) References Cited

U.S. PATENT DOCUMENTS

| | | | | | |
|---|---|---|---|---|---|
| 686,025 | A * | 11/1901 | Cannon | E05D 7/0027 | 16/248 |
| 959,001 | A * | 5/1910 | Tritsch | E05D 7/0027 | 16/243 |
| 5,016,317 | A * | 5/1991 | Hung | E05F 3/108 | 16/54 |
| 5,170,530 | A * | 12/1992 | Kopec | E05F 3/108 | 16/52 |
| 5,722,202 | A | 3/1998 | Cooper | | |
| 6,625,847 | B1 * | 9/2003 | Jones | E05F 3/108 | 16/51 |
| 6,871,381 | B1 | 3/2005 | Luca | | |
| 6,886,217 | B2 * | 5/2005 | Foster | E05F 3/108 | 16/69 |
| 7,356,878 | B2 * | 4/2008 | Foster | E05F 3/108 | 16/51 |
| 10,301,859 | B2 * | 5/2019 | Miglioranzo | E05F 3/108 | |
| 10,472,870 | B2 * | 11/2019 | Tassi | E05F 1/12 | |
| 2004/0111831 | A1 | 6/2004 | Foster | | |

FOREIGN PATENT DOCUMENTS

| | | | |
|---|---|---|---|
| CN | 203559678 | U | 4/2014 |
| EP | 0723621 | A1 | 7/1996 |
| GB | 2044840 | A | 10/1980 |
| GB | 2456508 | A | 7/2009 |
| GB | 2503753 | A | 1/2014 |
| GB | 2506236 | A | 3/2014 |
| WO | WO 2015145364 | A | 10/2015 |

OTHER PUBLICATIONS

Chinese Office Action, corresponding to Chinese Patent Application No. 2018800250643, dated Oct. 10, 2020, 2 pages.

International Search Report and Written Opinion dated Jun. 1, 2018 in PCT/GB2018/050394.

UK Search Report, dated May 18, 2017, in GB Patent Application No. 1702330.0, 2 pp.

* cited by examiner

DOOR CLOSERS

DESCRIPTION OF INVENTION

Embodiments of this invention relate to door closers of the type including an anchor assembly for fixing to a door frame and an actuator assembly intended for concealed fitting within the thickness of a door leaf and, more particularly, to door closers whereby the anchor assembly has an adjustor plate that is moveable relative to a frame mounting plate such that a door leaf to which the actuator assembly is mounted can be raised and lowered relative to a door frame to which the frame mounting plate is fixed. Embodiments of the invention also relate door closers which have a link whose length is less than approximately 40 mm.

Door closers of the type having an anchor assembly for fixing to a door frame and an actuator assembly intended for concealed fitting within the thickness of a door leaf are disclosed in our earlier patent, GB2456508, the content of which is hereby incorporated by reference.

A problem with such door closers is that they are not suitable for use in conjunction with door hinges that are vertically adjustable when a door leaf is mounted on a door frame. Door hinges having vertical adjustment when in situ allow for the raising and lowering of a door leaf relative to a door frame, without having to remove the door leaf from the door frame. Attempting to raise or lower a door leaf relative to a door frame when the door system is fitted with a door closer described in GB2456508 can cause various components of the door closer and/or door hinge to experience undesirable forces which can, in turn, reduce the lifespan of the door closer and/or door hinge. For example, referring to FIG. 2 of GB2456508, the linkages and parallel shafts of the door closer can become skewed out of the horizontal plane if the door leaf is raised or lowered relative to the door frame. Skewing the linkages and parallel shafts out of the horizontal plane can induce weaknesses in the door closer, in particular in the components of the operating assembly and/or damper mechanism. Such weaknesses can lead to premature failure of the door closer.

A further problem with such door closers is that they are not suitable for use with hinges that have a variable pivot axis.

A concealed hinge is one example of a hinge having a variable pivot axis. It is known that as the part of a concealed hinge that is connected to a door leaf pivots about the part that is connected to a door frame the axis about which the parts pivot moves in the horizontal plane. This is in contrast to a butt hinge, whereby as the part of the butt hinge that is connected to a door leaf pivots about the part that is connected to a door frame the axis about which the parts pivot remains fixed. Attempting to fit a door closer described in GB2456508 to a door system that is fitted with a hinge having a variable pivot axis (such as a concealed hinge) can also cause various components of the door closer and/or door hinge to experience undesirable forces which can, in turn, reduce the lifespan of the door closer and/or door hinge. For example, referring to FIG. 1 of GB2456508, when fitted to a door system having a variable pivot axis hinge the linkages and parallel shafts can come into contact with the edge mounting member and/or outwardly extending flange parts as the door leaf is pivoted relative to the door frame. Such contact occurs because the pivot axis of the hinge moves in the horizontal plane as the door leaf is pivoted. It is to be appreciated that such contact can induce weaknesses in the door closer which can, in turn, lead to premature failure of the door closer.

There is a need, therefore, to provide door closers that have increased lifespans and/or are more versatile when compared to known door closers.

Embodiments of the invention provide door closers that seek to overcome, or at least substantially reduce, the disadvantages discussed above in relation to lifespan and/or versatility. For instance, embodiments of the invention provide door closers that can be used in door systems that are fitted with hinges having any one or more of the following features: vertical adjustability when in situ; no vertical adjustability when in situ; a variable pivot axis; and a fixed pivot axis.

In one aspect of the invention, we provide a door closer, including:

- an anchor assembly, including:
  - a frame mounting plate which is fixable relative to a door frame; and
  - an adjustor plate; and
- an actuator assembly for mounting within the thickness of a door leaf to move the door leaf between open and closed configurations relative to the door frame, the actuator assembly including an operating member coupled by a link to the adjustor plate and mounted for a range of movements between a fully retracted position, in which the anchor assembly is held adjacent the actuator assembly when the door leaf is in the closed configuration, and an extended position, in which the anchor assembly is in spaced relation to the actuator assembly when the door leaf is in the open configuration, the link being configured to extend from the adjustor plate along a first axis (A-A), wherein the frame mounting plate is provided with one or more slot(s), the or each slot being elongated along a second axis (B-B), the second axis being generally orthogonal to the first axis.

Thus, when the door closer is in situ, the adjustor plate is moveable relative to the frame mounting plate in either direction along the second axis (B-B), such that a door leaf to which the actuator assembly is mounted can be raised and lowered relative to a door frame to which the frame mounting plate is fixed.

The door closer may include more than one link.

The or each link may have a length of less than approximately 40 mm, e.g. between approximately 25 mm and approximately 40 mm, e.g. between approximately 30 mm and approximately 40 mm, e.g. between approximately 33 mm and approximately 37 mm, e.g. approximately 35 mm.

The or each link may be in the form of a rod-like member.

The or each link may be pivotably connected to the adjustor plate.

The adjustor plate may include one or more transverse pin(s), e.g. to which the or each link may be pivotably connected.

The or each transverse pin may pass through a selected one of the slots of the frame mounting plate, such that the or each transverse pin extends through the thickness of the frame mounting plate.

The door closer may include one or more fasteners which pass through respective slots of the frame mounting plate and engage with respective apertures of the adjustor plate.

The or each fastener may include an adjusting screw, whereby the adjusting screw is rotatable in order to vary the distance between the frame mounting plate and the adjustor plate.

The adjustor plate may include at least two separate plate members.

The door closer may include a door leaf mounting plate provided with one or more slot(s), wherein the or each slot is elongated along a third axis (C-C), the third axis (C-C) being generally orthogonal to the first axis (A-A) and generally orthogonal to the second axis (B-B).

The actuator assembly may include a damper mechanism operatively connected to the operating member so as to damp movement of the operating member at least as it is driven in a direction towards the fully retracted position.

In a second aspect of the invention, we provide a door closer, including:

an anchor assembly; and an actuator assembly for mounting within the thickness of a door leaf to move the door leaf between open and closed configurations relative to a door frame, the actuator assembly including an operating member coupled by a link to the anchor assembly and mounted for a range of movements between a fully retracted position, in which the anchor assembly is held adjacent the actuator assembly when the door leaf is in the closed configuration, and an extended position, in which the anchor assembly is in spaced relation to the actuator assembly when the door leaf is in the open configuration, wherein the link has a length of less than approximately 40 mm.

The door closer may include more than one link.

The or each link may have a length of less than approximately 40 mm, e.g. between approximately 25 mm and approximately 40 mm, e.g. between approximately 30 mm and approximately 40 mm, e.g. between approximately 33 mm and approximately 37 mm, e.g. approximately 35 mm.

The or each link may be in the form of a rod-like member.

The anchor assembly may include:

a frame mounting plate which is fixable relative to a door frame; and an adjustor plate, the link being configured to extend from the adjustor plate along a first axis (A-A), and wherein the frame mounting plate is provided with one or more slot(s), the or each slot being elongated along a second axis (B-B), the second axis being generally orthogonal to the first axis.

The or each link may be pivotably connected to the adjustor plate.

The adjustor plate may include one or more transverse pin(s), e.g. to which the or each link may be pivotably connected.

The or each transverse pin may pass through a selected one of the slots of the frame mounting plate, such that the or each transverse pin extends through the thickness of the frame mounting plate.

The door closer may include one or more fasteners which pass through respective slots of the frame mounting plate and engage with respective apertures of the adjustor plate.

The or each fastener may include an adjusting screw, whereby the adjusting screw is rotatable in order to vary the distance between the frame mounting plate and the adjustor plate.

The door closer may include a door leaf mounting plate provided with one or more slot(s), wherein the or each slot is elongated along a third axis (C-C), the third axis (C-C) being generally orthogonal to the first axis (A-A) and generally orthogonal to the second axis (B-B).

The actuator assembly may include a damper mechanism operatively connected to the operating member so as to damp movement of the operating member at least as it is driven in a direction towards the fully retracted position.

The adjustor plate may include at least two separate plate members.

The adjustor plate may include a first part and a second part, the first part being attachable to a door frame and the second part being attachable to the frame mounting plate, one of the first part and the second part may include an aperture for receiving an adjustment member which enables the distance between the frame mounting plate and the adjustor plate to be varied, and one of the first and the second part may include a formation which enables adjustment of the position of the door leaf relative to the door frame in a direction parallel to the second axis (B-B).

The first part of the adjustor plate may include the aperture for receiving the adjustment member, and the second part of the adjustor plate may include the formation enabling adjustment of the door leaf relative to the door frame in a direction parallel to the second axis (B-B).

The formation enabling adjustment of the door leaf relative to the door frame in a direction parallel to the second axis (B-B) may include at least one elongate slot with which a fastener is engageable.

Embodiments of the various aspects of the invention will now be described by way of example only and with reference to the accompanying drawings, of which:

Figure 1:
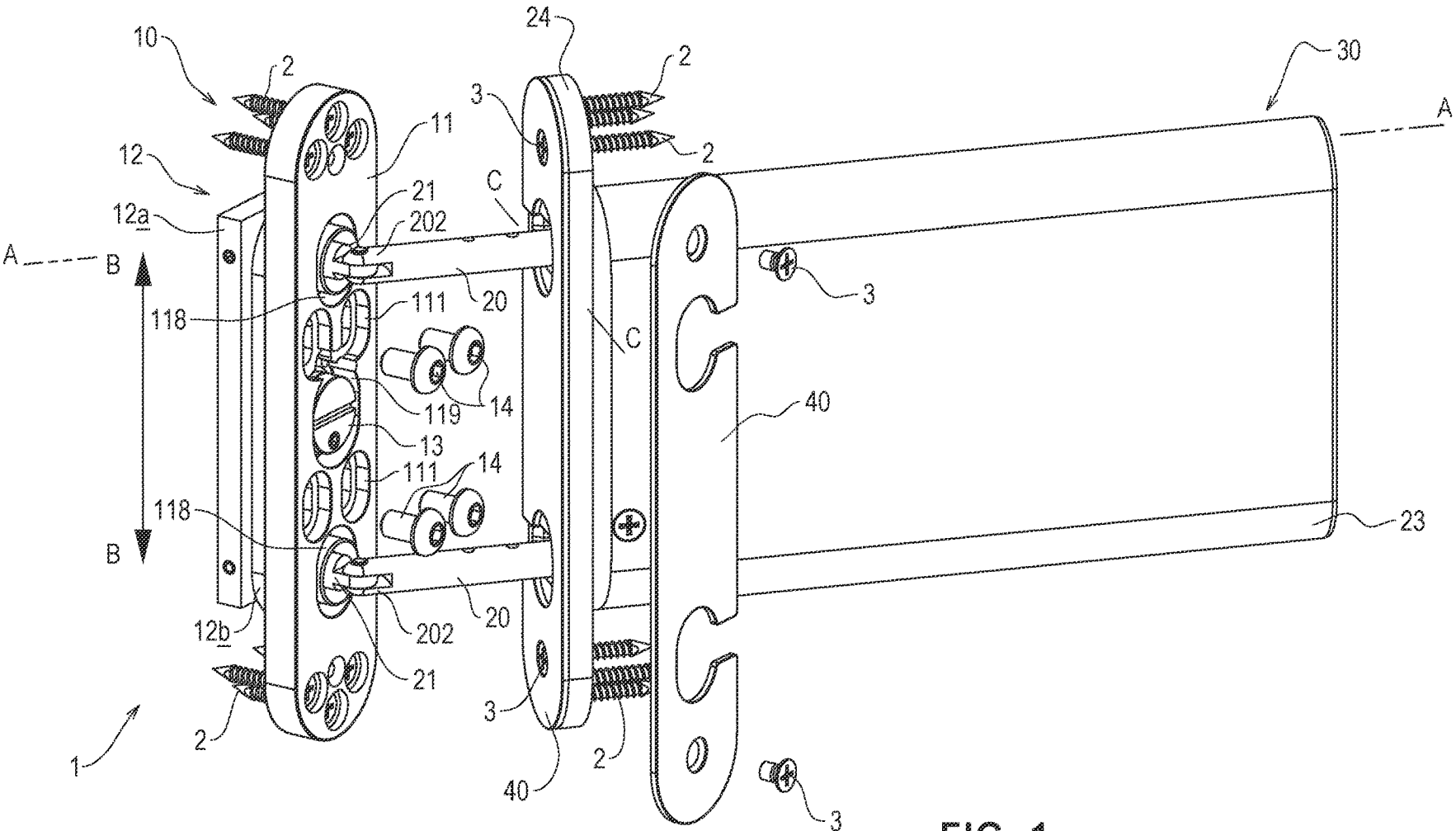
FIG. 1 shows a perspective view of a door closer in accordance with an embodiment of the invention.

With reference in particular to FIG. 1, in some embodiments a door closer 1 may include an anchor assembly 10 which is, in use, mounted in or on an edge of a door frame facing an edge of a door leaf that is hinged to the door frame, and an actuator assembly 30 which is mounted, in use, within the thickness of the door leaf.

The anchor assembly 10 may include a frame mounting plate 11 which is fixable relative to the door frame, and an adjustor plate, indicated generally at 12, which is located adjacent the frame mounting plate 11 on the side thereof remote from the door leaf.

The actuator assembly 30 is so dimensioned as to be suitable for fitting within the thickness of a door leaf and for this purpose is provided with a housing 23 and a door leaf mounting plate 24. The door leaf mounting plate 24 is fixable relative to the door leaf so as to hold the housing 23 in place.

Figure 6B:
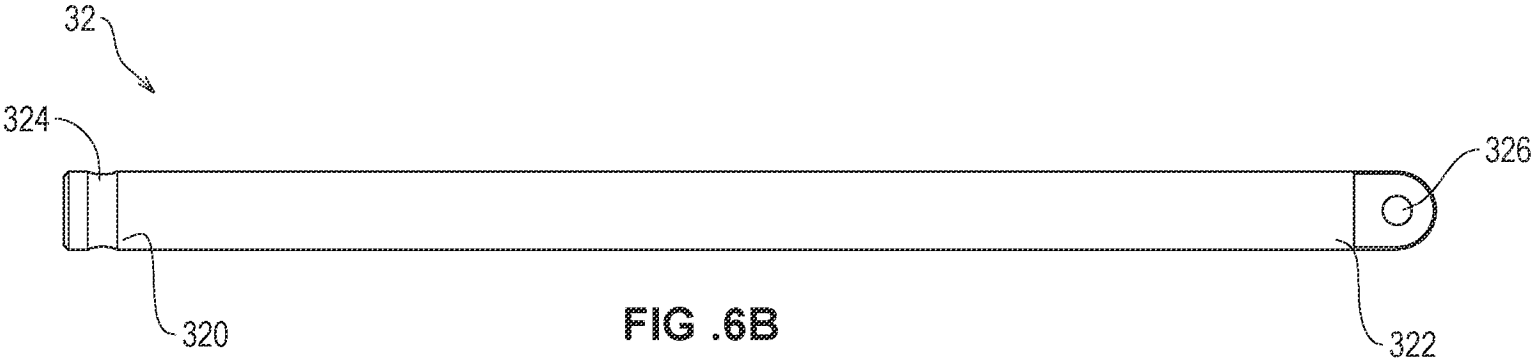
FIG. 6 shows plan (a) and side (b) views of a shaft.
Figure 6A:
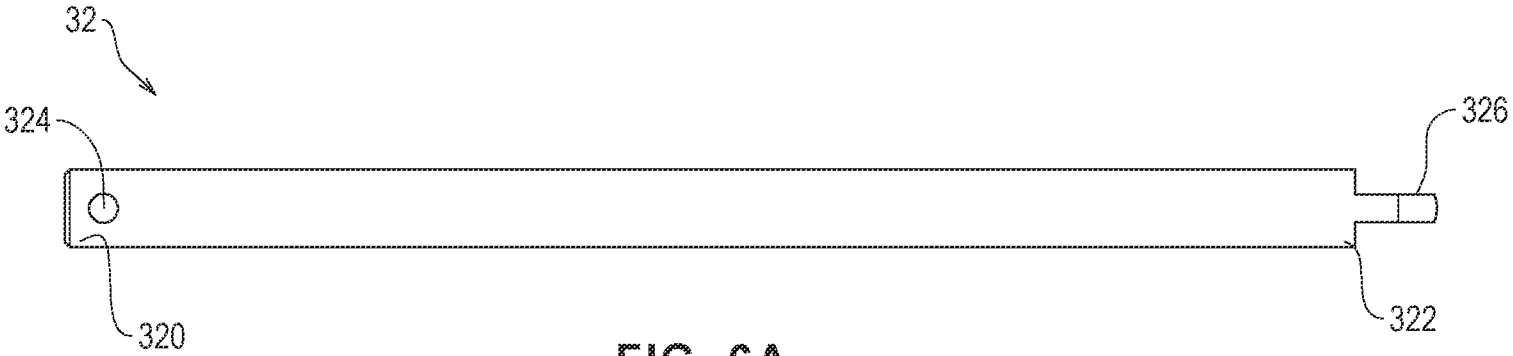

Within the housing 23 of the actuator assembly 30 there is provided an operating member which operates in a manner known in the art. In some embodiments, the operating member may include a pair of parallel shafts 32. An example of such a shaft 32 is shown in FIG. 6.

In some embodiments, the operating member may include one shaft 32, or more than two (e.g. three, four, five, etc.) shafts 32.

The operating member is coupled by a link 20 to the adjustor plate 12 and mounted for a range of movements between a fully retracted position, in which the anchor assembly 10 is held adjacent the actuator assembly 30 when the door leaf is in the closed configuration, and an extended position, in which the anchor assembly 10 is in spaced relation to the actuator assembly 30 when the door leaf is in the open configuration.

The link 20 extends along an axis A-A and the operating member moves in the housing 23 along the axis A-A as the door leaf is opened and closed. It is to be appreciated, therefore, that the direction of the axis A-A changes as the door leaf is pivoted; the direction of the axis A-A moves in a horizontal plane as the door leaf is opened and closed.

The operating member is biased inwardly of the housing 23 towards the retracted or "door closed" configuration, e.g. as described in GB2456508.

In some embodiments, the actuator assembly 30 may include a damper mechanism (not shown) to regulate the rate of closure of the door leaf relative to the door frame.

Figure 2A:
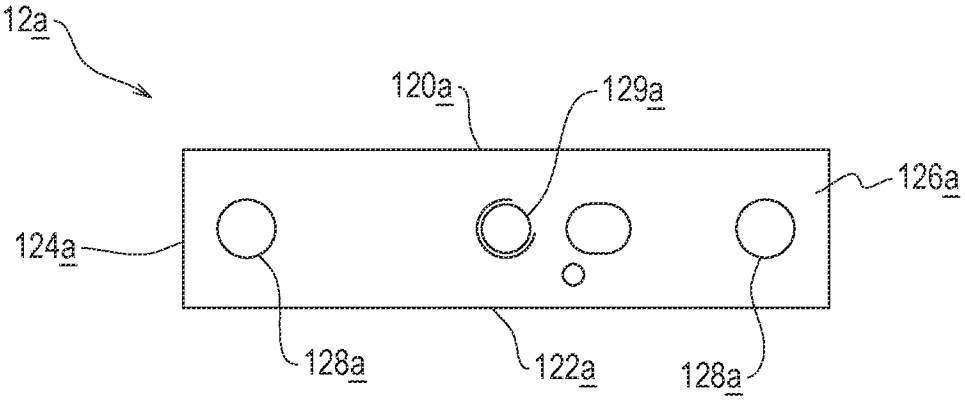
FIG. 2 shows plan (a) and side (b) views of a first part of an adjustor plate.
Figure 2B:
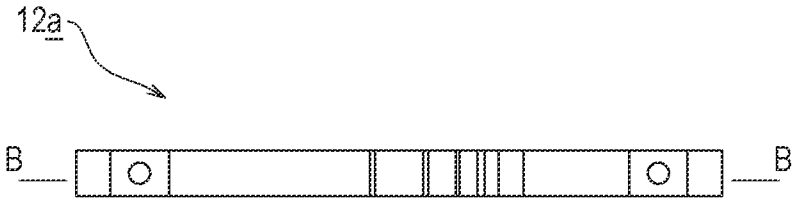
Figure 3B:
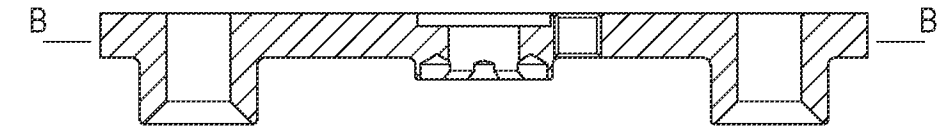
FIG. 3 shows plan (a) and side (b) views of a second part of an adjustor plate.
Figure 3A:
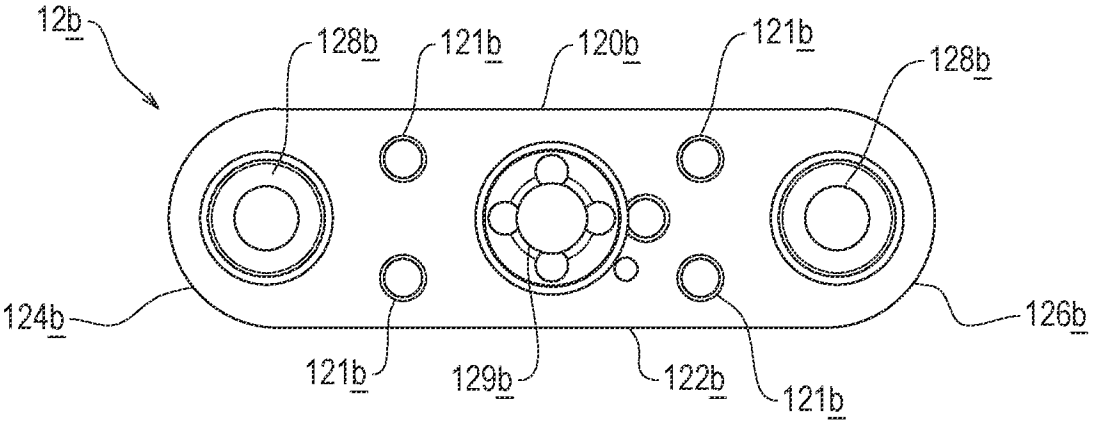

In some embodiments, for example in embodiments where the door closer 1 has vertical adjustability, the adjustor plate 12 may include a first part 12*a* (shown in FIG. 2) and a second part 12*b* (shown in FIG. 3). In some embodiments, for example in embodiments where the door closer 1 need not have vertical adjustability, the adjustor plate 12 may be formed as a single part. In some embodiments (not shown) the adjustor plate 12 may include more than two separable parts.

With reference to FIG. 2, the first part 12*a* of the adjustor plate 12 may include a first pair of facing edges 120*a*, 122*a* and a second pair of facing edges 124*a*, 126*a*, which connect the first pair of facing edges 120*a*, 122*a* to one another. The first pair of facing edges 120*a*, 122*a* may be longer than the second pair of facing edges 124*a*, 126*a*. When the door closer 1 is in situ, the first pair of facing edges 120*a*, 122*a* lies substantially in or parallel to an axis B-B which is at 90° relative to the axis A-A. The first part 12*a* may also be provided with one or more aperture(s) 128*a*, 129*a*, e.g. one aperture 128*a* may be located adjacent each of the second pair of facing edges 124*a*, 126*a*. One or more of the aperture(s) 128*a*, 129*a* may be threaded.

With reference to FIG. 3, the second part 12*b* of the adjustor plate 12 may include a first pair of facing edges 120*b*, 122*b* and a second pair of facing edges 124*b*, 126*b*, which connect the first pair of facing edges 120*b*, 122*b* to one another. The first pair of facing edges 120*b*, 122*b* may be longer than the second pair of facing edges 124*b*, 126*b*. In use, the second part 12*b* is orientated relative to the first part 12*a* such that the first pair of facing edges 120*b*, 122*b* lies substantially in or parallel to the axis B-B. The second part 12*b* may be provided with one or more aperture(s) 128*b*, which align with the aperture(s) 128*a* of the first part 12*a*. The second part 12*b* may be provided with aperture 129*b*, which may be threaded.

In some embodiments, the second part 12*b* may have formed therein one or more aperture(s) 121*b*, which may be threaded. The embodiment shown in FIG. 3 has four apertures 121*b*, although it is to be appreciated that other embodiments (not shown) may have fewer or more than four apertures 121*b* without departing from the scope of the invention.

Figure 4B:
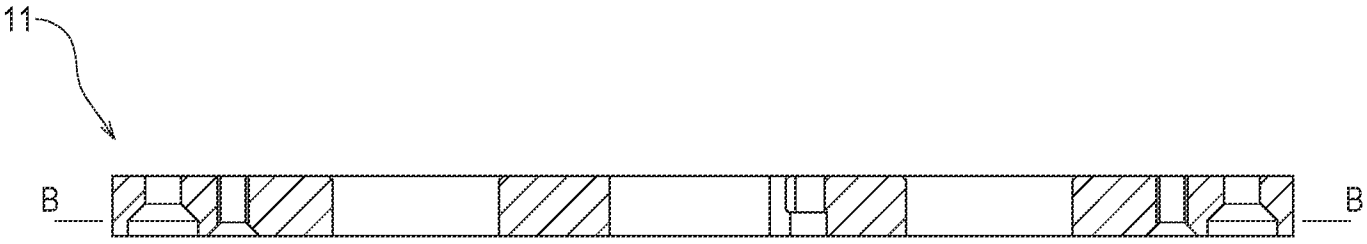
FIG. 4 shows plan (a) and side (b) views of a frame mounting plate.
Figure 4A:
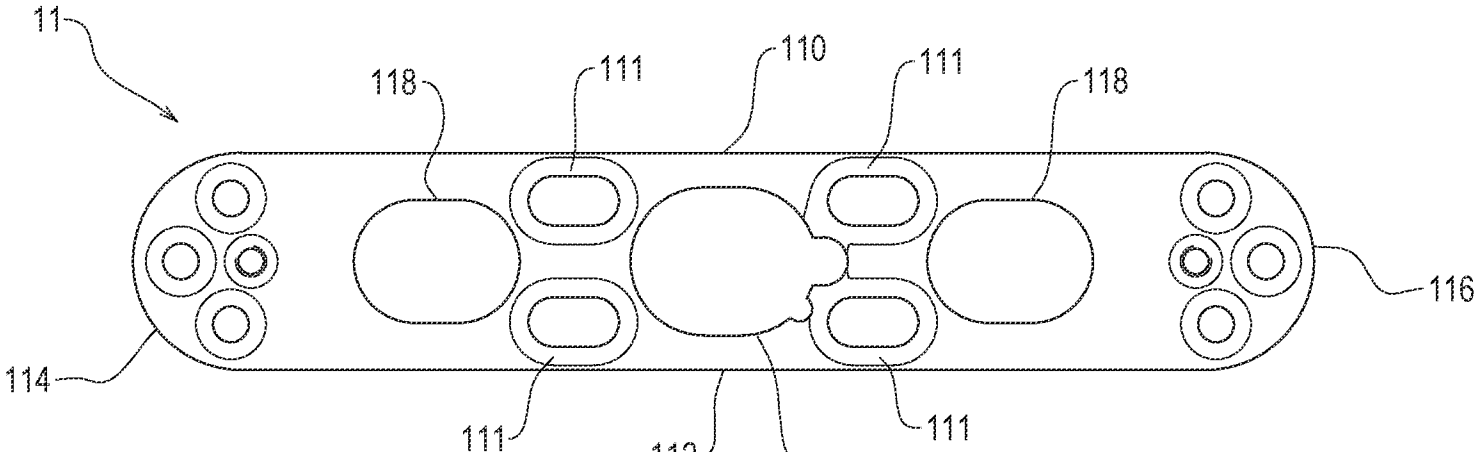

Referring to FIG. 4, in some embodiments the frame mounting plate 11 may include a first pair of facing edges 110, 112 and a second pair of facing edges 114, 116, which connect the first pair of facing edges 110, 112 to one another. The first pair of facing edges 110, 112 may be longer than the second pair of facing edges 114, 116. In use, the frame mounting plate 11 is orientated relative to the adjustor plate 12 such that the first pair of facing edges 110, 112 lies substantially in or parallel to the axis B-B.

In some embodiments, the frame mounting plate 11 may be provided with one or more aperture(s) 118, which align with the apertures 128*a*, 128*b* of the respective first and second parts 12*a*, 12*b*. In some embodiments, the one or more aperture(s) 118 may be in the form of one or more slot(s).

Referring to FIG. 1, in some embodiments, the frame mounting plate 11 may be provided with apertures to receive fixing screws 2 for fixing the anchor assembly 10 to the frame. In some embodiments, the frame mounting plate 11 may be provided with apertures to receive fixing screws 3 for fixing a cover plate 40 thereto. The purpose of the cover plate 40 is primarily to improve the aesthetic appearance of the door closer 1.

Referring back to FIG. 4, in some embodiments, the frame mounting plate 11 may include one or more aperture(s) 111 which, in use, align substantially with the aperture(s) 121*b* of the second part 12*b*. In some embodiments, the one or more aperture(s) 111 may be in the form or one or more slots. The frame mounting plate 11 may include an aperture 119 which, in use, aligns with aperture 129*b* of the second part 12*b*. In some embodiments, the aperture 111 may be in the form of a slot.

In some embodiments, the slot(s) 111, 118, 119 may be elongated and extend in the direction of the axis B-B.

Figure 5B:
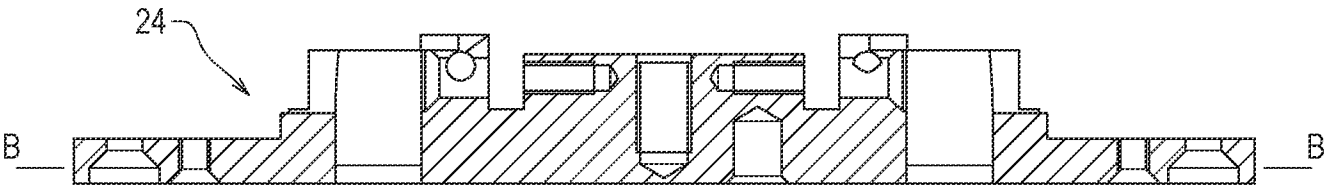
FIG. 5 shows plan (a) and side (b) views of an door leaf mounting plate.
Figure 5A:
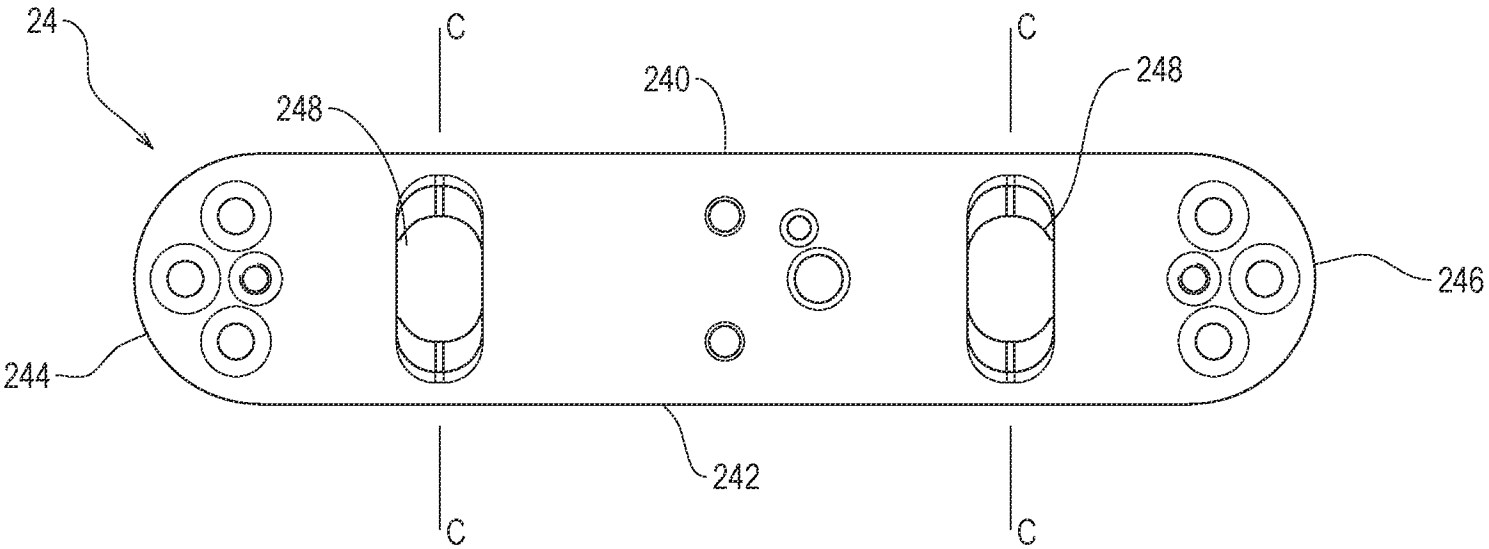

With reference to FIG. 5, the door leaf mounting plate 24 may include a first pair of facing edges 240, 242 and a second pair of facing edges 244, 246, which connect the first pair of facing edges 240, 242 to one another. The first pair of facing edges 240, 242 may be longer than the second pair of facing edges 244, 246.

Referring to FIG. 1, in some embodiments, the door leaf mounting plate 24 may be provided with apertures to receive fixing screws 2 for fixing the housing 23 within the door leaf. When fixed to the door leaf the first pair of facing edges 240, 242 of the door leaf mounting plate 24 lies substantially in or parallel to the axis B-B. In some embodiments, the door leaf mounting plate 24 may be provided with apertures to receive fixing screws 3 for fixing a cover plate 40 thereto. The purpose of the cover plate 40 is primarily to improve the aesthetic appearance of the door closer 1.

Referring back to FIG. 5, the door leaf mounting plate 24 may be provided with one or more slot(s) 248, which, when the frame mounting plate 11 and the door leaf mounting plate 24 are fitted to the respective door frame and door leaf, align substantially with the slot(s) 118 of the frame mounting plate 11. In some embodiments, the or each slot 248 may be elongated along an axis C-C, the axis C-C being at 90° relative to the axis B-B. It is to be appreciated that the axis C-C is also at 90° relative to the axis A-A. In other words, the or each slot 248 may extend between the facing edges 240, 242 of the door leaf mounting plate 24.

Referring to FIG. 6 there is shown a shaft 32 having a first end 320 and a second end 322. In some embodiments, the shaft 32 may include a first linking member 324, e.g. in the form of a drilled hole, at or adjacent the first end 320 thereof. The first linking member 324 is for connecting the shaft 32 to components of the operating member located within the housing 23. In some embodiments, the shaft 32 may include a second linking member 326, e.g. in the form of a drilled hole, at or adjacent the second end 322 thereof. The second linking member 324 is for pivotably connecting the shaft 32 to a link 20.

Figure 7B:
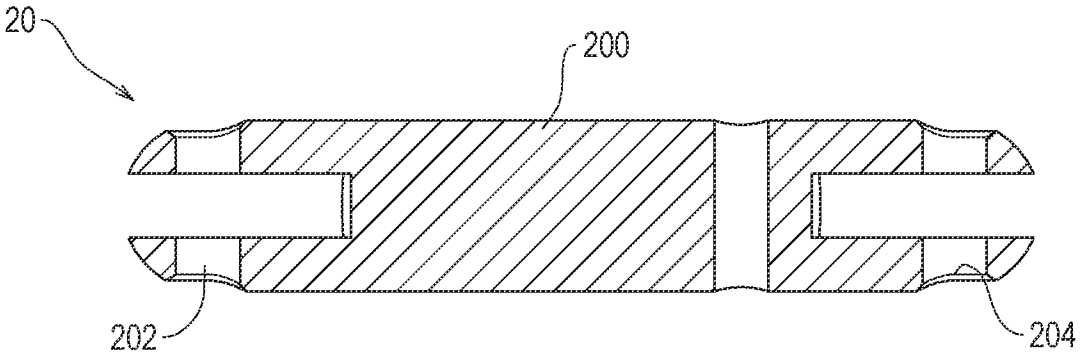
FIG. 7 shows plan (a) and side (b) views of a link.
Figure 7A:
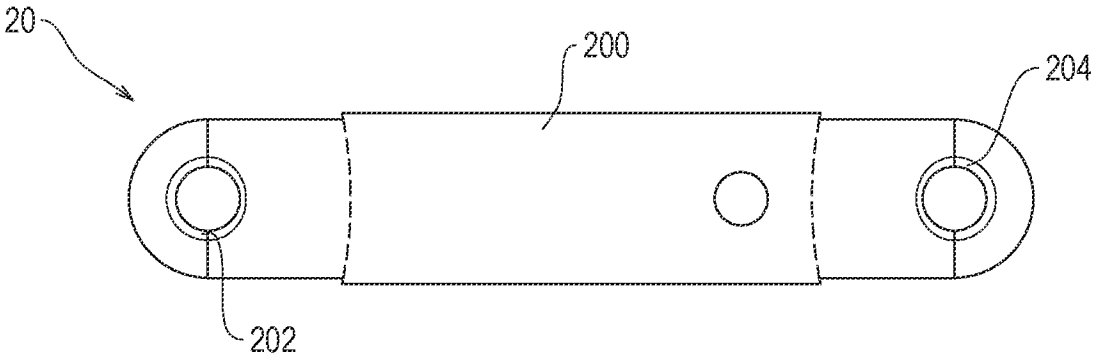

Referring to FIG. 7, there is shown a link 20 having a body 200 provided at each end with respective linking members 202, 204, e.g. in the form of drilled holes.

The link 20 may be in the form of a rod-like member (as shown in the figures). The link may be substantially straight along the majority of its length.

In some embodiments, the link 20 may take other forms such as that of a plate-like member or a chain.

In some embodiments, there may be more than one link 20. For instance, the embodiments shown in the figures have two links 20 but in other embodiments fewer (e.g. one) or more (e.g. three, four, five, etc.) links 20 may be provided.

In some embodiments, the or each link 20 may have a length of less than approximately 40 mm. For instance, the or each link 20 may have a length of approximately 35 mm±2 mm.

In some embodiments, the link 20 may have a length of approximately 40 mm or greater, e.g. 45 mm±2 mm.

The or each link 20 may be pivotably connected to the adjustor plate 12 through the slots 118 of the frame mounting plate 11. In some embodiments, the adjustor plate 12 may include one or more transverse pin(s) 21, to which the or each link 20 may be pivotably connected.

Figure 8B:
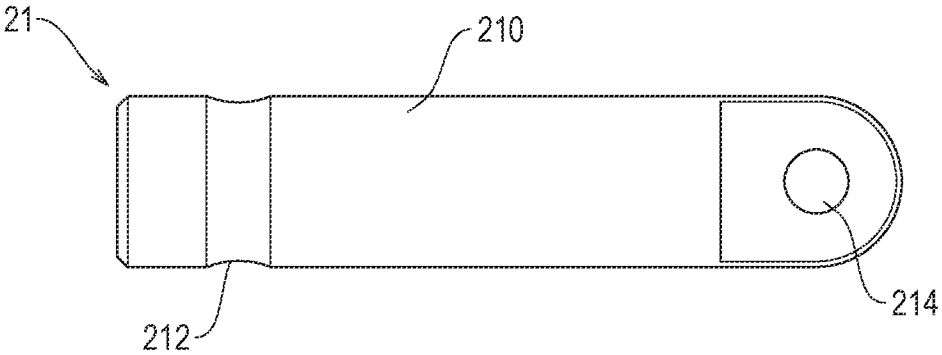
FIG. 8 shows plan (a) and side (b) views of a transverse pin.
Figure 8A:
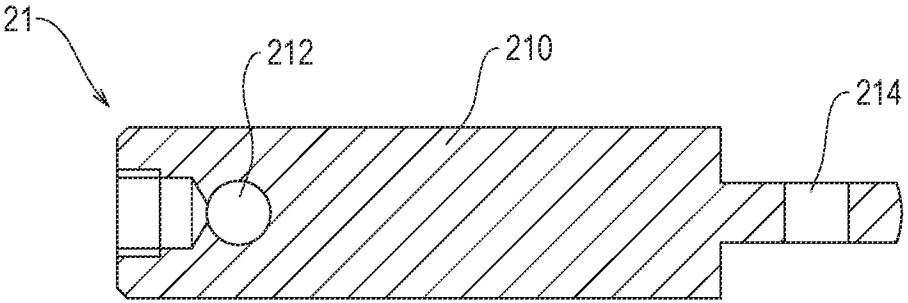

Referring to FIG. 8, there is shown a transverse pin 21 having a body 210 provided at each end with respective linking members 212, 214, e.g. in the form of drilled holes.

Referring to FIG. 1, each shaft 32 (not visible since they are accommodated within the housing 23) is pivotably connected to one end 204 of a respective link 20, e.g. by a pin, so that each shaft 32 can pivot relative to its respective link 20. The end 202 of each link 20 is connected to the adjustor plate 12. In some embodiments, the end 202 of each link 20 may be connected to the adjustor plate 12 by the respective transverse pin 21.

In some embodiments, the or each transverse pin 21 may be fixed to the first part 12*a* of the adjustor plate 12 and pass through apertures 128*b* and slots 118 of the respective second part 12*b* and frame mounting plate 11, such that the or each transverse pin 21 extends through the thickness of the second part 12*b* and frame mounting plate 11.

In some embodiments, the or each transverse pin 21 may be formed integrally with the first part 12*a* and/or the second part 12*b*.

In some embodiments, an adjustment member, for example an adjusting screw 13 extends through the aperture 129*b* of the second part 12*b* and is engaged in the aperture 129*a* of the first part 12*a* of the adjustor plate 12. It is to be appreciated that the adjusting screw 13 passes through the slot 119 of the frame mounting plate 11. Rotation of the adjusting screw 13 varies the distance between the frame mounting plate 11 and the adjustor plate 12 in a manner known in the art.

In some embodiments, fasteners 14 may be provided which engage with the respective apertures 121*b* of the second part 12*b*. It is to be appreciated that the fasteners 14 pass through the slots 111 of the frame mounting plate 11.

Advantageously, in some embodiments the door closer 1 is such that a door leaf to which the actuator assembly 30 is mounted can be raised and lowered relative to a door frame to which the frame mounting plate 11 is fixed when the door leaf is hinged to the door frame.

Referring to FIG. 9, it will now be explained how a door leaf may be raised or lowered whilst being hinged to a door frame and fitted with a door closer 1 according to an embodiment of the invention. In this situation the hinge(s) connecting the door leaf and door frame must be vertically adjustable when in situ, but may have a variable pivot axis (e.g. a concealed hinge) or a fixed pivot axis (e.g. a butt hinge).

Figure 9B:
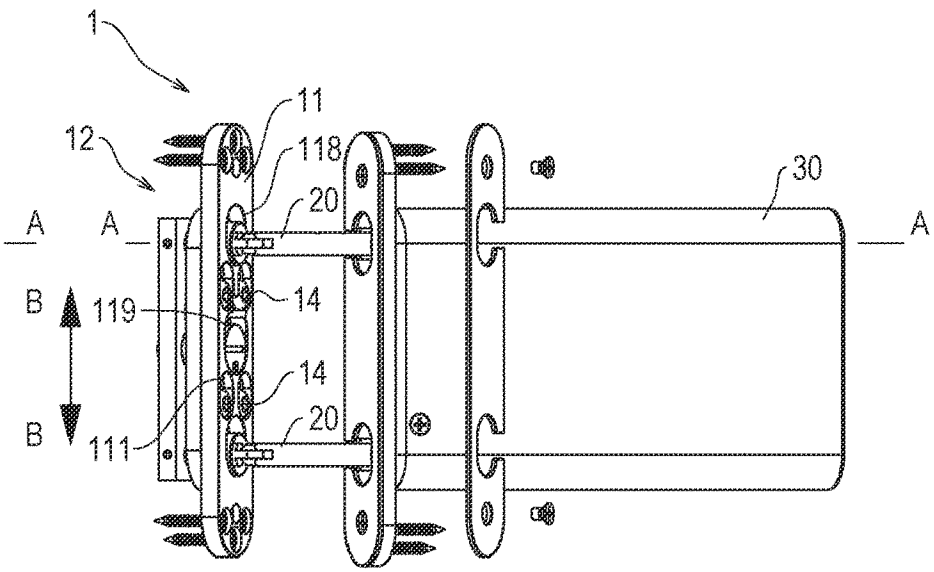
FIG. 9 shows side views of a door closer in accordance with an embodiment of the invention shown in first (a) and second (b) configurations.
Figure 9A:
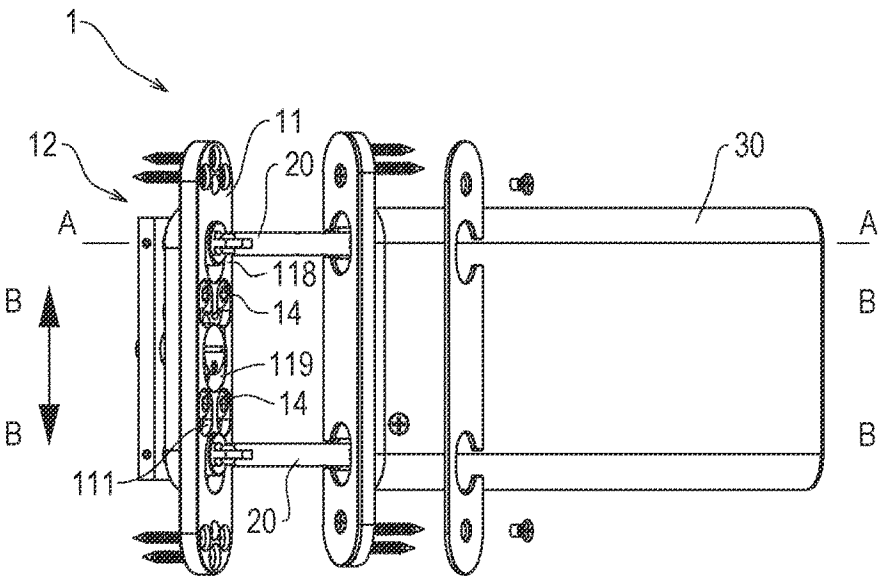

FIG. 9*a* shows a door closer 1 in a first configuration which corresponds to a door leaf to which the actuator assembly 30 is mounted being set at its maximum raised position relative to a door frame to which the frame mounting plate 11 is fixed. FIG. 9*b* shows the door closer 1 in a second configuration which corresponds to the door leaf being set at its maximum lowered position relative to the door frame.

To move between the first and second configurations the fasteners 14 are loosened, so that the adjustor plate 12 can be moved relative to the frame mounting plate 11 along the axis B-B. This means that the actuator assembly 30 (and door leaf to which it is mounted) can be moved along the axis B-B relative to the frame mounting plate 11 (and door frame to which it is fixed).

The fact that the slots 111, 118, 119 are elongated along the axis B-B means that the adjustor plate 12 and the parts coupled thereto (such as links 20 and actuator assembly 30) can be moved without hindrance in either direction along the axis B-B.

An advantage of this aspect of the invention is that the links 20 and shafts 32 do not become skewed out of the horizontal plane as the door leaf is raised or lowered relative to the door frame. Instead, as can be seen from FIGS. 9*a* and 9*b*, the links 20 (and hence respective shafts 32) remain in the horizontal plane when the actuator assembly 30 is set at its maximum raised position (FIG. 9*a*) and maximum lowered position (FIG. 9*b*) relative to the frame mounting plate 11, or any position in between the maximum raised and maximum lowered positions. Consequently, door closers 1 according to this aspect of the invention can be used with door systems fitted with hinges that are vertically adjustable when the door leaf and door frame are fixed to one another. The provision of the slots 111, 118, 119 means that the adjustor plate 12 (and hence actuator assembly 30 to which it is connected) can be moved relative to the frame mounting plate 11 which, in turn, can prolong the lifespan of the door closer 1 and also the hinges themselves.

The provision of the slot 119, in particular, has the further advantage that, if desired, it is possible to retain the feature of the adjusting screw 13 for varying the distance between the frame mounting plate 11 and the adjustor plate 12. It is to be appreciated that without the slot 119 it would not be possible to move the adjustor plate 12 along the axis B-B relative to the frame mounting plate 11 and have the ability to vary the distance between the frame mounting plate 11 and adjustor plate 12. It is also to be appreciated that in order for the door closer 1 to exhibit adjustability along the axis B-B and the ability to vary the distance between the frame mounting plate 11 and adjustor plate 12 the adjustor plate 12 must be formed into at least two separate parts 12*a*, 12*b*. The adjusting screw 13 is engaged with the first part 12*a* to permit variation in the distance between the frame mounting plate 11 and adjustor plate 12 and the fasteners 14 are engaged with the second part 12*b* to permit adjustability along or parallel to the axis B-B. This is adjustability enables the door leaf to be adjusted relative to the door frame vertically, i.e. in a direction parallel to the second axis (B-B).

The applicant has surprisingly found that by ensuring that the length of the or each link 20 is less than approximately 40 mm (e.g. approximately 35 mm±2 mm) the life of the door closer 1 and/or the door hinges can be prolonged. This may be particularly advantageous when the door closer 1 is fitted to a door system fitted with variable pivot axis hinge (such as a concealed hinge), although this feature may also be beneficial in a door system fitted with a butt hinge. For door systems fitted with a butt hinge, the part of the hinge that is connected to the door leaf pivots relative to the part of the hinge that is connected to the door frame about a pivot axis which remains stationary during movement of the door leaf relative to the door frame. The range of movements of the door leaf with respect to the door frame is defined by the angular displacement of the part of the hinge that is connected to the door leaf relative to the part of the hinge that is connected to the door frame. However, for door systems fitted with one or more variable pivot hinges, the range of movements of the door leaf with respect to the door frame may be different from that of a door system including one or more butt hinges, and may vary dependent upon the characteristics of the type of variable pivot hinge(s) used. In contrast to butt hinges, the pivot axis of a variable pivot hinge, about which the part of the hinge which is connected to the door leaf pivots relative to the part of the hinge which is connected to the door frame is not fixed. The axis may sweep along a substantially horizontal path as the door leaf is pivoted relative to the door frame. In other words, the pivot axis may undergo linear displacement in a substantially horizontal direction as the door leaf is moved, for example as the door is opened or closed. A path swept by the pivot axis may be dependent on other parameters of the door system, such as the type and configuration of the variable pivot axis hinge(s). As a result, the movement of the link 20 in a door system including one or more variable pivot hinges, as the door leaf is moved relative to the door frame, may be different from that of link 20 in a door system which includes butt hinges, as it is defined by at least the angular movement of the door leaf with respect to the door frame and any displacement of the pivot axis in a substantially horizontal direction. The applicant has developed an advantageous configuration of the door closer 1, the effect of which is that the door closer 1 may be installed in door systems including either one or more butt hinges or one or more variable pivot axis hinges whilst maintaining smooth operation and a reduction in the wear and tear of the door closer 1 and the hinge(s) included in the door system. In embodiments where the length of the or each link 20 is less than approximately 40 mm (e.g. approximately 35 mm±2 mm), the pivoting connection between the or each link 20 and its respective shaft 32 exits the housing 23 via respective slots 248 in the door leaf mounting plate 24 as the door leaf pivots about the door frame towards its open configuration but before the pivot axis of the variable pivot axis hinge starts to move in the horizontal plane. Consequently, neither the link 20 nor its respective shaft 32 come into contact with the door leaf mounting plate 24 when the door closer 1 according to this aspect of the invention is fitted to a door system having a variable pivot axis hinge. In this situation the hinge(s) connecting the door leaf and door frame may or may not be vertically adjustable when in situ.

A further beneficial feature of embodiments of the invention is the fact that the slots 248 extend along the axis C-C. In embodiments, an appropriate extension of the slots 248 along the axis C-C may be determined by the length of the or each link 20. Since the axis C-C is at 90° relative to the axis A-A there is an additional effect that when the link 20 and slots 248 are appropriately and/or correspondingly dimensioned, it is further ensured that neither the link 20 nor its respective shaft 32 come into contact with the door leaf mounting plate 24 as the door leaf pivots about the door frame towards its open configuration. Consequently, the life of the door closer 1 may be further prolonged.

It is to be appreciated that whilst the figures show embodiments in which the adjustor plate 12 includes separate first and second parts 12*a*, 12*b*, in some embodiments (for example embodiments where vertical adjustability is not essential) either one of the first and second parts 12*a*, 12*b* may be omitted. Therefore, features described in relation to the first part 12*a* may be provided on the second part 12*b*, and vice versa.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A door system including:
a door frame;
a door leaf;
at least one hinge having a variable pivot axis;
a door closer including:
an anchor assembly; and
an actuator assembly for mounting within the thickness of the door leaf to move the door leaf between open and closed configurations relative to the door frame, the actuator assembly including a door leaf mounting plate provided with one or more horizontal slots, an operating member coupled by one or more links to the anchor assembly and mounted for a range of movements between a fully retracted position, in which the anchor assembly is held adjacent the actuator assembly when the door leaf is in the closed configuration, and an extended position, in which the anchor assembly is in spaced relation to the actuator assembly when the door leaf is in the open configuration, wherein the or each link and the corresponding one of the one or more horizontal slots are configured so that the or each link passes through a respective one of the one or more horizontal slots without contacting the door mounting plate as the door leaf moves between open and closed configurations relative to the door frame.

2. A door system according to claim 1, wherein the or each link has a length which enables the link to exit the door leaf as the door leaf moves from its closed configuration to its open configuration but before the pivot axis of the hinge moves in the horizontal plane.

3. A door system according to claim 1, wherein the or each link has a length of between 25 mm and 40 mm.

4. A door system according to claim 1, wherein the or each link is in the form of a rod-shaped member.

5. A door system according to claim 1, wherein the anchor assembly includes:
a frame mounting plate which is fixable relative to the door frame; and
an adjustor plate, the link being configured to extend from the adjustor plate, and wherein the frame mounting plate is provided with one or more slots.

6. A door system according to claim 5, wherein the link is pivotably connected to the adjustor plate.

7. A door system according to claim 5, wherein the adjustor plate includes one or more transverse pins, and wherein the or each transverse pin passes through a selected one of the slots of the frame mounting plate, such that the or each transverse pin extends through the thickness of the frame mounting plate.

8. A door system according to claim 5, including one or more fasteners, and wherein the or each fastener passes through a selected one of the slots of the frame mounting plate and engage with respective apertures of the adjustor plate, and wherein the or each fastener includes an adjusting screw, whereby the adjusting screw is rotatable in order to vary the distance between the frame mounting plate and the adjustor plate.

9. A door system according to claim 1, wherein the actuator assembly includes a damper mechanism operatively connected to the operating member so as to damp movement of the operating member at least as it is driven in a direction towards the fully retracted position.

* * * * *